US005417174A

United States Patent [19]

Allison et al.

[11] Patent Number: 5,417,174

[45] Date of Patent: May 23, 1995

[54] AUTOMATIC TROUSER INDEXING METHOD AND APPARATUS FOR BELT LOOP ATTACHMENT

[76] Inventors: Kenneth S. Allison, 2825 Stratfield Ct., Cumming, Ga. 30131; Yoichi Enomoto, 2605 Cardinal Lake Cir., Duluth, Ga. 30136; Hideho Sasamoto, 3164 Shady Wood Cir., Lawrenceville, Ga. 30244; David G. Thomason, 2181 Appleton Cir., Lawrenceville, Ga. 30243

[21] Appl. No.: 85,336

[22] Filed: Jun. 29, 1993

[51] Int. Cl.[6] ..... D05B 3/12; D05B 19/00

[52] U.S. Cl. ..... 112/265.1; 112/121.11; 112/104

[58] Field of Search ..... 112/104, 121.11, 121.27, 112/265.1, 262.2, 278, 270, 272, 273

[56] References Cited

U.S. PATENT DOCUMENTS

| | | | |
|---|---|---|---|
| 3,562,817 | 8/1969 | Huddelston . | |
| 3,661,106 | 5/1972 | Huddelston | 112/121.27 X |
| 3,750,603 | 8/1973 | Martin | 112/121.11 X |
| 3,752,099 | 8/1973 | Hunter, Jr. et al. | 112/121.27 |
| 4,137,857 | 2/1979 | Miyachi et al. | 112/121.27 |
| 4,287,842 | 9/1981 | Breck, Jr. . | |
| 4,389,957 | 6/1983 | Block et al. . | |
| 4,393,800 | 7/1983 | Hargett . | |
| 4,530,294 | 7/1985 | Pollmeier et al. . | |
| 4,555,999 | 12/1985 | Conner . | |
| 4,602,579 | 7/1986 | Pollmeier et al. | 112/121.27 X |

*Primary Examiner*—Clifford D. Crowder
*Assistant Examiner*—Paul C. Lewis

[57] ABSTRACT

A method and apparatus for indexing the waistband of trousers into belt loop attachment positions at the stitching station of a sewing machine is disclosed. A stepper motor is drivingly engaged to an indexer clamp, which engages the end portion of the waistband. The stepper motor drives the indexer clamp and pulls the waistband through the stitching station. A detector detects the presence of a waistband seam and signals a controller which correlates the position of the side seam as a reference point with the desired attachment positions of belt loops. The controller signals the stepper motor to stop when each of successive belt loop attachment positions move into the stitching station. The controller operates a belt loop delivery system which feeds a belt loop to the stitching station. Work holding clamps secure the belt loop onto the waistband. The belt loops are stitched onto the waistband as each successive belt loop attachment position enters the stitching station.

23 Claims, 10 Drawing Sheets

AUTOMATIC TROUSER INDEXING METHOD AND APPARATUS FOR BELT LOOP ATTACHMENT

FIELD OF THE INVENTION

This invention relates to a method and apparatus of indexing the waistband of trousers into belt loop attachment positions at the stitching station of a sewing machine where belt loops are stitched onto the waistband.

BACKGROUND OF THE INVENTION

Trousers, such as jeans, have belt loops that are stitched onto the waistband at predetermined intervals. The loops are stitched either manually or automatically depending on the manufacturing plant and machinery setup.

In manual belt loop stitching, an operator advances the waistband by hand through a stitching station of a sewing machine, places a belt loop over the waistband, and stitches the belt loop. This type of belt loop stitching is expensive, time-consuming and labor intensive. An automated belt loop stitching setup therefore has become more desirable.

In one automated system, indicia marks corresponding to the desired belt loop positions are placed on the waistband. The stitching machinery senses the marks by appropriate sensing systems and automatically stitches the belt loops onto the waistbands where a mark has been sensed. This system requires an extra step, i.e., marking the waistband, thus raising production and other attendant costs.

In the automated belt loop stitching operation disclosed in U.S. Pat. No. 4,555,999 to Conner, marks are not placed on the waistband, thus overcoming the marking drawback of the prior system. In Conner, the operator places the waistband at the stitching station beginning at the rear seam, and then stitches a belt loop. The machine automatically indexes the waistband counterclockwise to the end while counting the distance with a stepper motor control unit. The machine then reverses machine direction and indexes to the correct loop positions while stopping waistband movement intermittently for belt loop stitching based on the measured distance of the entire waistband.

Although the Conner apparatus automates belt loop attachment, it has some drawbacks because 1) the indexed positions must be calculated symmetrically from the rear seam, and 2) the trousers must be reversibly moved through the apparatus, first in one direction, followed by movement in the reverse direction.

It would be more desirable to use known reference points which are formed integral to the trousers for correlating the belt loop positions on the waistband. Such reference points would desirably include the waistband seams. Because the seams are formed integral with the trousers, there is no need to apply separate indicia as noted above. Because belt loop attachment positions are correlated with known reference points such as seams it would not be necessary to calculate distance based on the time consuming, reversing movement such as disclosed in Conner.

During production, known variables such as the detected position of a seam and the required number of belt loops would be correlated. As the waistband moves through a stitching station, belt loops could be stitched at intermittent intervals without requiring complex waistband measurements such as the reversible waistband movement disclosed in Conner. Additionally, any detection means would preferably be simple, using electromechanical apparatus that register the bulge of a seam or other integrally formed structure rather than complex electronic sensing apparatus such as in Conner.

SUMMARY OF THE INVENTION

It is therefore an object of the present invention to provide a method and apparatus of indexing the waistband of trousers into belt loop attachment positions at the stitching station of a sewing machine where the position of belt loops is determined relative to a permanent structure formed integral to the trousers.

It is another object of the present invention to provide a method and apparatus of incrementally and automatically moving the waistband of trousers into belt loop attachment positions at the stitching station of a sewing machine where the waistband does not have to be reversibly moved.

It is still another object of the present invention to provide an apparatus and method of indexing the waistband of trousers into belt loop attachment positions at the stitching station of a sewing machine without requiring the step of measuring the length of the waistband during production.

It is still another object of the present invention to provide a method and apparatus for indexing the waistband of trousers into belt loop attachment positions at the stitching station of a sewing machine where the presence of waistband seams may be detected by mechanically simple means.

These and other objects and advantages of the invention are set forth in the description that follows and, in part will be obvious from the description and advantages being realized and entertained by means of the instrumentation, facts, apparatus, systems, steps and procedures, as particularly pointed out in the specification.

In accordance with the present invention, the end of the waistband where the end waistband loop is positioned is first placed at the stitching station of the sewing machine. The first belt loop is stitched. The waistband is moved lengthwise through the stitching station and the presence of waistband seams is detected to provide correlated reference points relative to the belt loop attachment positions. The waistband movement is stopped as the belt loop attachment positions successively move into the stitching station.

The belt loop attachment apparatus includes a frame that attaches to a sewing machine frame. A sewing machine arm and bed define a stitching station where belt loops are stitched onto the waistband of trousers. Drive means engages the waistband and moves the waistband lengthwise through the stitching station.

In one embodiment the drive means includes an indexer clamp that engages the end of the waistband. A stepper motor is drivingly connected to the indexer clamp for driving the indexer clamp and moving the waistband in one direction lengthwise through the stitching station. A vertically oriented bearing rail is positioned on the frame and supports the indexer clamp. As the stepper motor drives the indexer clamp downward along the bearing rail, the waistband is pulled through the stitching station.

Roller means is positioned before the stitching station for engaging and guiding the waistband into the stitching station. The roller means comprises an inner guide roller that engages the inside portion of a waistband and an outer guide roller assembly having rollers that engage the outer portion of the waistband. Seam detection means detects the presence of a seam. In one embodiment, the seam detection means is a lever pivotally mounted to the outer guide roller assembly. The lever engages and rides over the waistband and pivots when it engages the bulged portion of a seam. Signal generating means is operatively connected to the lever and responsive to pivoting lever movement so as to generate signals indicative of the presence of a seam.

Control means in the preferred form of a microprocessor controls the movement of the waistband to the stitching station to position the waistband for incremental stitching of belt loops. The control means is operatively connected to both the signal generating means of the seam detector and the stepper motor for (1) receiving signals from the signal generating means indicative of the presence of a seam, (2) correlating the detected seam position with the belt loop attachment positions, and (3) controlling the stepper motor to stop when each of the succeeding belt loop attachment positions move into the stitching station.

DESCRIPTION OF THE DRAWINGS

The foregoing and other objects and advantages of the present invention will be appreciated more fully from the following description, with references to the accompanying drawings in which.

DETAILED DESCRIPTION OF THE INVENTION

Figure 1:
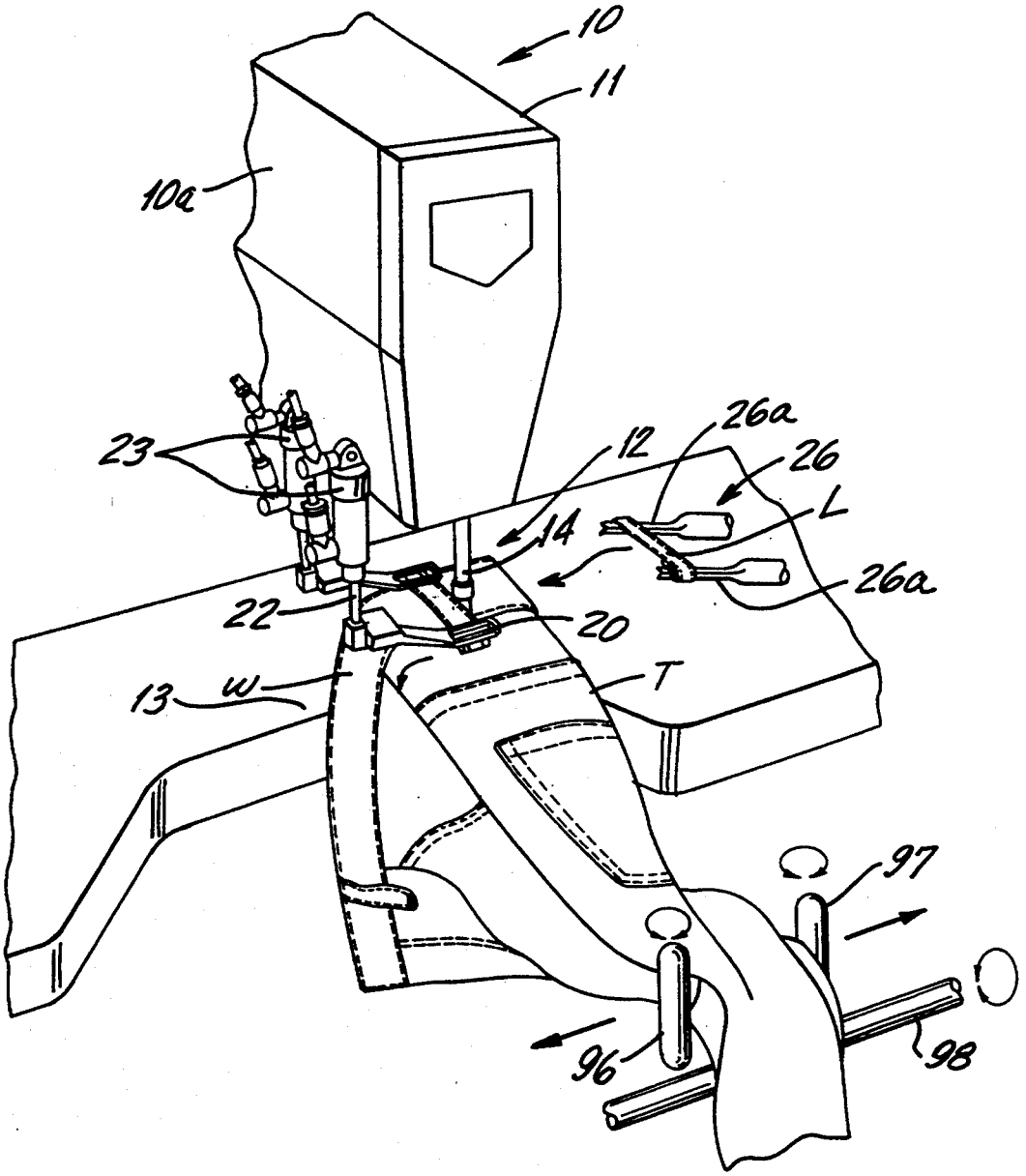
FIG. 1 is a pictorial view of a sewing machine showing the second belt loop being stitched onto the waistband.
Figure 7:
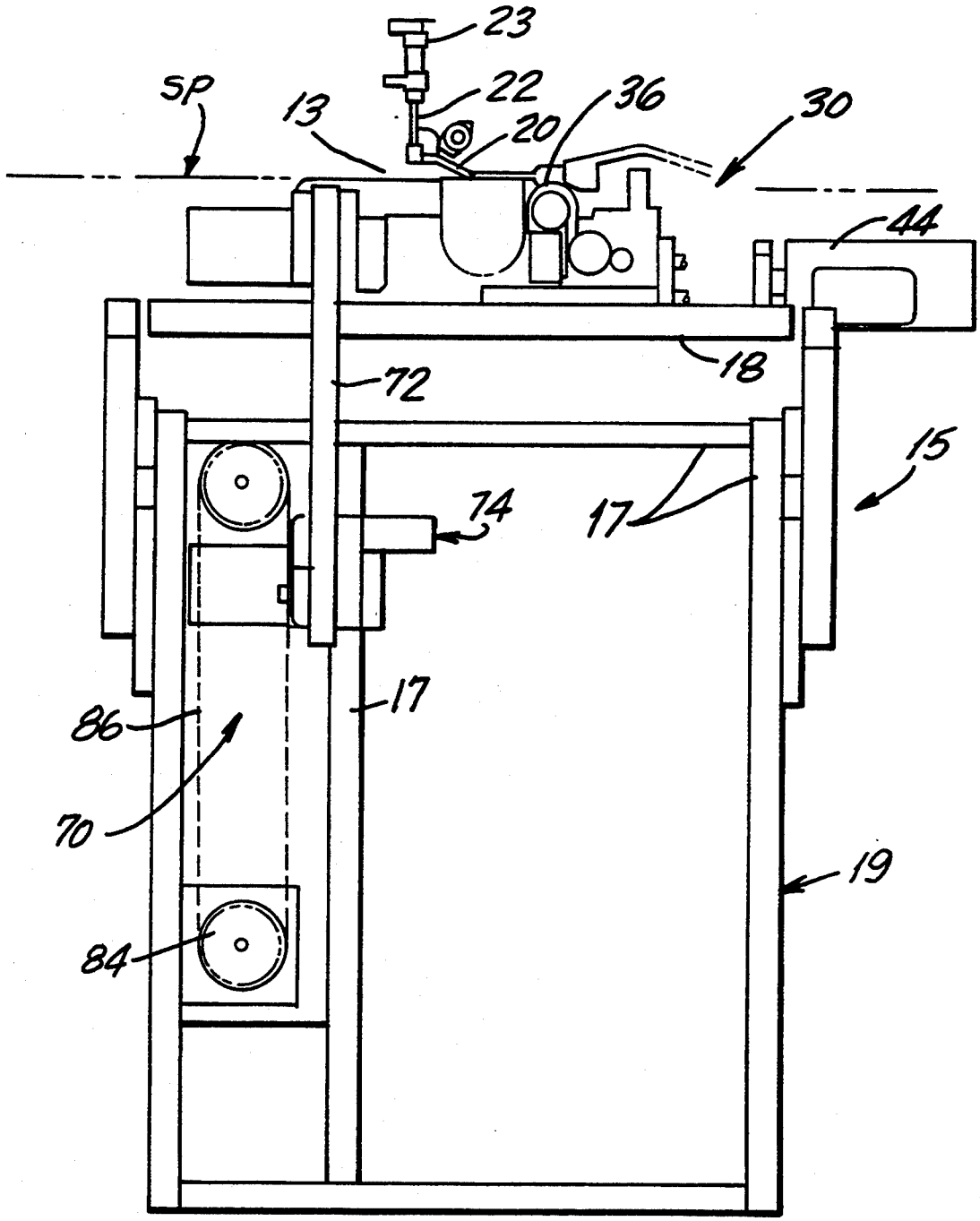
FIG. 7 is a front elevation view of the sewing machine and support frame showing the indexer clamp assembly and servo motor.

Referring now to the drawings and more particularly to FIG. 1, there is illustrated at 10 a portion of a conventional sewing machine, having a sewing machine arm 11 extending outward therefrom which defines a stitching station, indicated generally at 12 where belt loops "L" are stitched onto the waistband "W", of a pair of trousers "T" (FIG. 1). As is conventional, the sewing machine 10 includes a sewing machine bed 13 on which the waistband W rests. The bed 13 defines a stitching plane, indicated by the cutting plane line SP, where the sewing machine needle assembly 14 engages the stitched material at the stitching station 12 (FIG. 7). A housing 10*a* covers the machine and protects the internal machine components.

The sewing machine includes a frame, indicated generally at 15. Although not illustrated in detail, the sewing machine frame 15 typically extends to the floor surface. The indexer attachment of the present invention, indicated generally at 19, is connected to and supported by the sewing machine frame 15. (FIG. 7). The indexer attachment 19 includes a frame assembly 17 that extends upward to the table top surface 18 of the sewing machine frame.

The sewing machine 10 has first and second bartack positions, which allows the trousers to be shifted during the sewing of a belt loop, such as is well known to those skilled in the art. Work holding clamps 20 (FIGS. 1 and 7) are supported by the output shaft 22 of pressure cylinders 23 which are fixed to the sewing machine housing 10*a*. As the output shaft 22 is extended, the work holding clamps 20 move into an extended position at the stitching station 12 to press a belt loop onto the waistband W.

A belt loop delivery system, indicated schematically at 26 (FIG. 1), moves belt loops into the stitching station and onto the waistband for stitching. The belt loop delivery system 26 can be designed with varied apparatus as is well known to those skilled in the art. Typically, a cut mechanism well known to those skilled in the art (not shown) cuts belt loops from a continuous strip of folded belt loop fabric. The belt loop delivery system 26 includes a support member having a bifurcated end 26*a* that engages and supports respective ends of the belt loop as the loop is delivered to the stitching station 12.

Figure 5A:
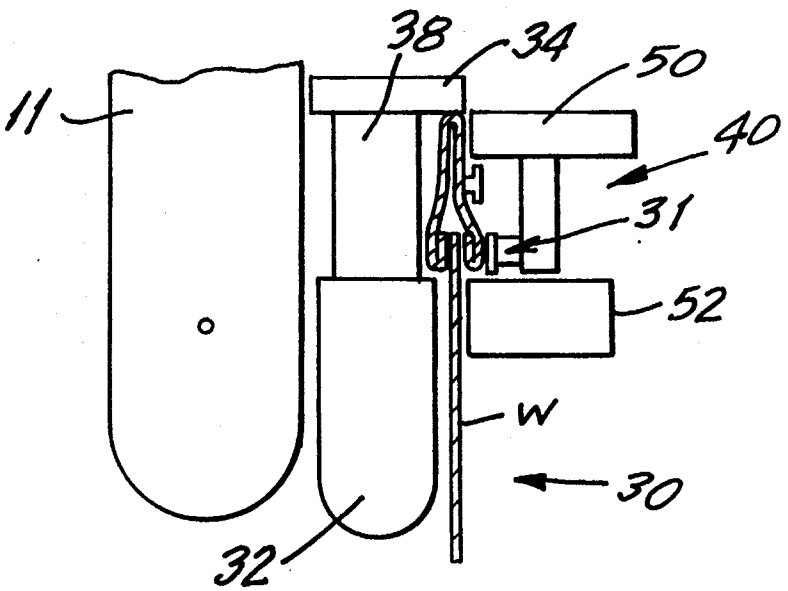
FIG. 5A is a more schematic plan view of FIG. 5.
Figure 4:
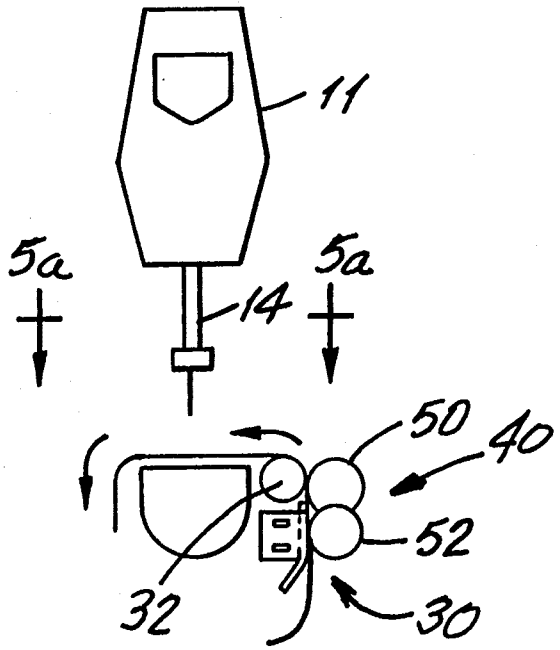
FIG. 4 is a highly schematic front elevation view of the sewing machine showing the waistband relative to the waistband guide roller assembly and stitching station.
Figure 5:
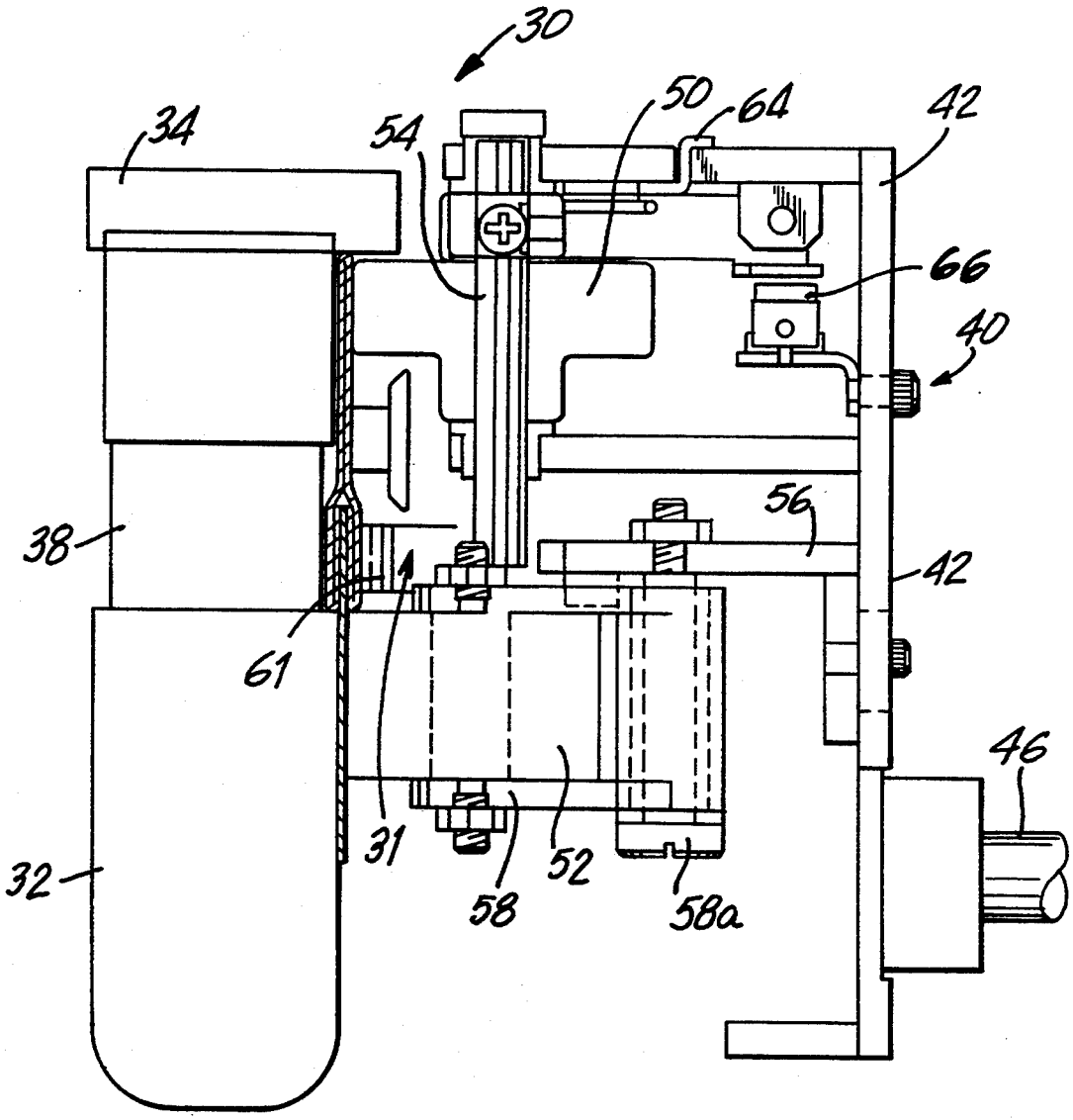
FIG. 5 is a plan view showing details of the seam detector and waistband guide roller assembly.
Figure 6:
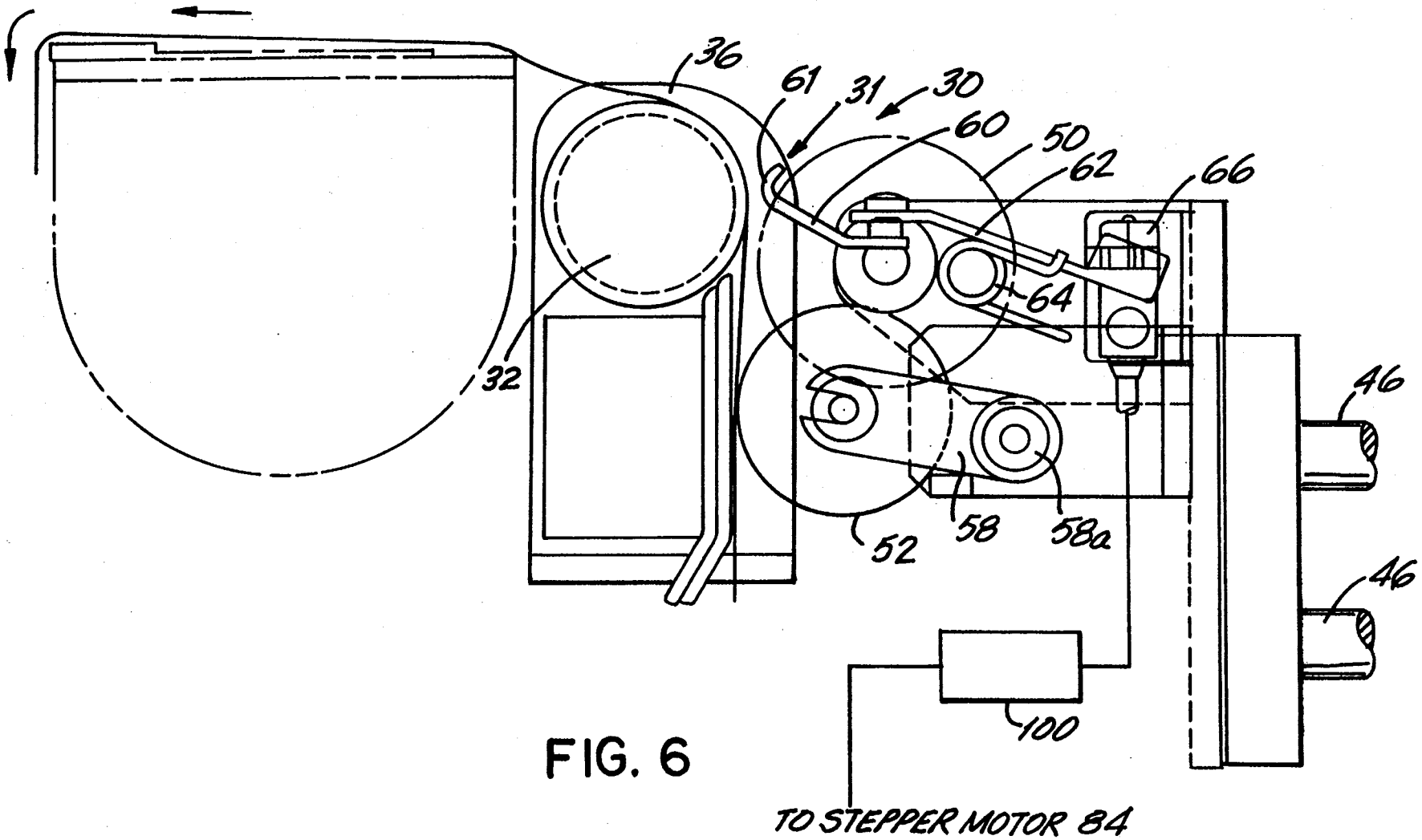
FIG. 6 is a schematic, front elevation view showing details of the seam detector and waistband guide roller assembly.

Referring now to FIGS. 5 and 6, details are illustrated of a waistband guide roller assembly, indicated generally at 30. The waistband guide roller assembly 30 is positioned adjacent to and before the stitching station 12, and guides the waistband into the stitching station without side-by-side displacement while maintaining tension on the waistband to prevent wrinkling and bunching of the fabric during production. In the illustrated embodiment, the waistband guide roller assembly 30, includes seam detection means 31 (FIGS. 4, 5 and 6) for detecting the presence of waistband seams as the waistband moves lengthwise through the stitching station 12. The seam detection means 31 of the present invention will be explained in further detail below. The guide roller assembly 30 is mounted to a linear bearing set of rails (not shown in detail) which mount to the table top surface 18.

The waistband guide roller assembly 30 includes a horizontally disposed, inner guide roller 32 which is rotatably mounted by a bearing support 34 to a vertical support member 36 of the table top surface 18 (FIG. 7). The inner guide roller 32 is positioned just below the stitching plane defined by the sewing machine bed 13 and the sewing machine needle assembly 14. The roller 32 includes a seam engaging portion 38 of reduced diameter which is either proximal to the support 34 (FIGS. 2 and 5*a*) or positioned medial as in FIG. 5. This seam engaging portion 38 is long enough to allow a seam to rest against that area.

Figure 2:
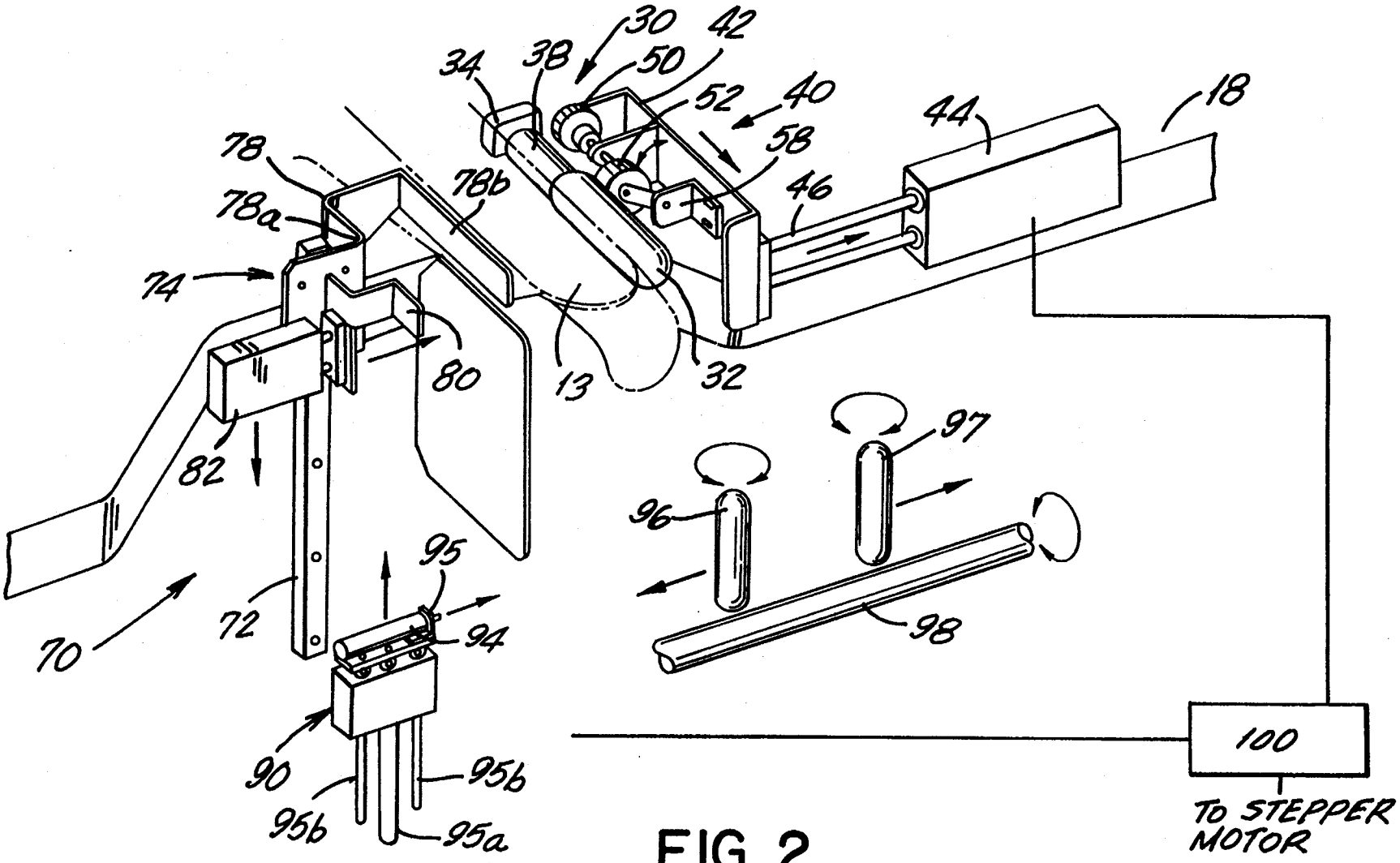
FIG. 2 is schematic, pictorial view of the indexer clamp assembly, pants leg roller assembly and waistband guide roller assembly in accordance with the present invention.

FIG. 2 illustrates a schematic, pictorial view of the outer guide roller assembly, indicated at 40. The assembly includes a substantially U-shaped support bracket 42 (FIG. 2) which is slidably mounted on the table top surface 18. A seam detector cylinder 44 is mounted on the table top surface 18 and drives the support bracket 42 to and from an area adjacent and before the stitching station by means of the cylinder piston shafts 46.

The outer guide roller assembly 40 is illustrated as having first and second rollers 50, 52 which engage and bias the outer portion of the waistband against the inner guide roller 32. The first roller 50 is mounted on a support shaft spindle 54 supported by the end of the bracket 42 (FIG. 5). The support shaft spindle 54 is free to rotate. The second roller 52 is pivotally mounted to a medial support bracket 56 via a pivot mount bracket 58 and mounting screw **58*a* so that the second roller acts as an adjustable waistband guide roller. The second roller 52** is positioned in a plane below the first roller (FIG. 4). A spring or other biasing mechanism (not shown) biases the roller against the waistband.

Although the figures illustrate two rollers 50, 52, a spring biased flat plate (not shown) can be substituted for the roller 50. The plate engages the seam and can provide a constant force thereon. In some cases, the use of a flat plate is preferred since it could provide a more even biasing force against the seam than roller 50.

As shown in FIG. 6, the seam detection means 31 includes a lever arm 60 secured to the support shaft spindle 54. The lever arm 60 is bent at its end to form a seam engaging end 61 that rides over the waistband and seam. The lever arm 60 engages a second lever arm 62 having a spring 64 connected thereto which biases the second lever arm downward against the seam detecting lever arm 60. The lever arm 60 is biased against the waistband and pivots upward as a seam passes under its end 61.

Signal generating means 66 is operatively connected to the spring biased second lever 62 to generate signals indicative of the presence of a seam as the lever arm 61 rides over a seam. As the seam passes under the lever 61, the signal generating means 66 detects pivoting of the second lever and generates a signal indicative of the pivoting and thus presence of a seam. In one embodiment, the signal generator is an inductive proximity sensor. The signal generating means 66 is operatively connected to a programmable logical control unit to generate seam detection signals to the control unit as will be explained in detail further.

Referring now to FIGS. 2 and 7, details of the indexer clamp assembly, are illustrated and indicated at 70. The indexer clamp assembly provides the drive force for pulling the waistband W of the trousers T counterclockwise through the stitching station 12 of the sewing machine 10 (FIG. 1). The indexer clamp assembly 70 includes a vertically oriented bearing rail 72 secured to the frame assembly 17. The bearing rail 72 extends from about the stitching plane "SP" defined by the bed 13 of the sewing machine 10 to about half-way down the frame assembly 17. An indexer clamp, indicated at 74, is slidably moveable on the bearing rail 72. The indexer clamp 74 includes a U-shaped indexer clamp bracket 78 having a first mounting leg **78*a* and a second longer clamping leg 78*b*. A bearing assembly (not shown) is bolted to the back of the indexer clamp bracket 78 and receives the bearing rail 72, allowing the bracket 78** to slide over the bearing rail.

An indexer clamp pressure member 80 is moveable on the indexer clamp bracket 78 from a retracted position where the longer leg **78*b* is spaced from the pressure member 80, and into an extended position where the pressure member 80 is clamped against the longer leg 78*b*, securing the waistband "W" for pulling. A pneumatic or hydraulic cylinder 82 is secured to the indexer clamp bracket 78 and provides the driving force via a piston to move the pressure member 80 against the leg 78*b*** to clamp the waistband for pulling.

Figure 7A:
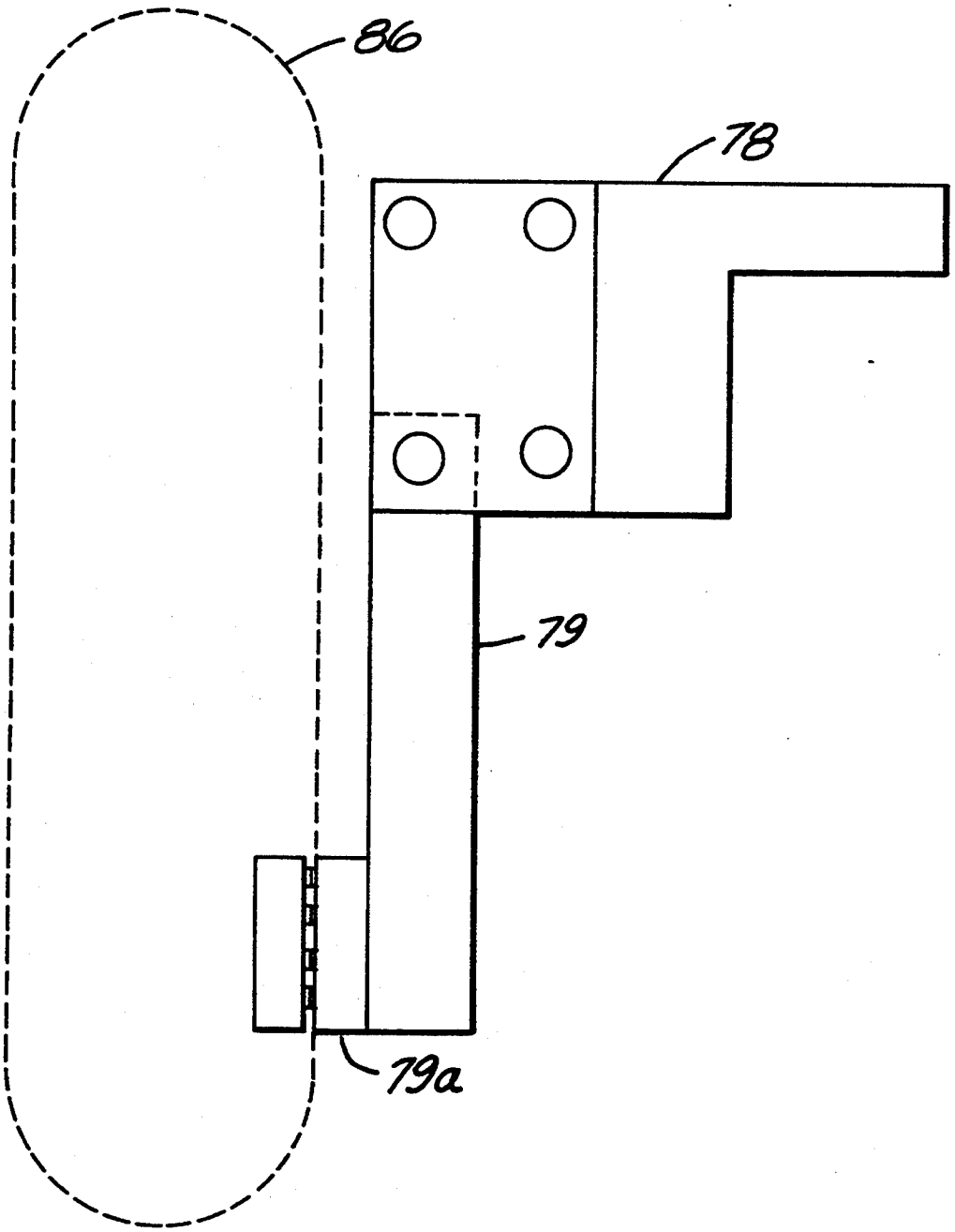
FIG. 7A shows a more detailed view of the timing belt and indexer clamp bracket.

A stepper motor 84 (FIG. 7)is fixed to the frame assembly 17. A timing belt 86 is operatively connected to the stepper motor 84 and the indexer clamp bracket 78 to impart the necessary force to move the indexer clamp bracket down the bearing rail 72 as the stepper motor 84 operates. FIG. 7A illustrates in greater detail the interconnection between the timing belt 86 and the indexer clamp bracket 78. The indexer clamp bracket 78 includes an extension arm 79 that extends downward. A lock clamp **79*a* secures the extension arm 79 to the timing belt so that as the stepper motor 84 turns the timing belt 86, the indexer clamp bracket 78** moves up and down.

An index stitching clamp assembly, indicated at 90, is mounted on the frame assembly 17 and is moveable vertically on the frame into a position opposing the stitching station 12 by a transmission assembly (not shown) known to those skilled in the art. The stitching clamp assembly 90 includes a stitching clamp cylinder 94 with an output shaft 95 that extends outward to clamp against a clamp plate 92 so that the trousers are fixed in position and cannot move until the work holding clamps 20 engage the waistband. An air cylinder **95*a* moves the stitching clamp cylinder 94 up and down on bridge guides 95*b***.

The frame assembly 17 supports two vertical pants legs rollers 96, 97 and a horizontal pants leg roller 98 which engage the pants or trouser legs during the stitching operation. The vertical and horizontal pants leg rollers 96, 97, 98 provide a moving and rotative force to the pants legs to allow the waistband to be guided adequately through the stitching station. The horizontal and vertical roller 96, 98 can be supported on a retractable or pivotable frame mount (not shown in detail) which allows the rollers to be moved into position around the trousers.

Programmable logic control means 100 in the form of a microprocessor such as an OMRON SYSMAC C28K or a 486 based microcomputer is operatively connected to the signal generating means 64 and the stepper motor 84. Signals generated by the signal generating means are generated to the programmable controller 100 which in turn controls operation of the stepper motor 84. The control means led is operatively connected to the stepper motor 84, the indexer clamp assembly 70, the seam detector cylinder 44, the stitching clamp assembly 90, the belt loop delivery system 26, and sewing machine 10 for controlling all aspects of the indexing and stitching operation. Typically, the control means 100 is contained in a housing (not shown) and includes one or more toggle switches which preselect the number of belt loops which are to be stitched onto the waistband.

METHOD OF OPERATION

Figure 8:
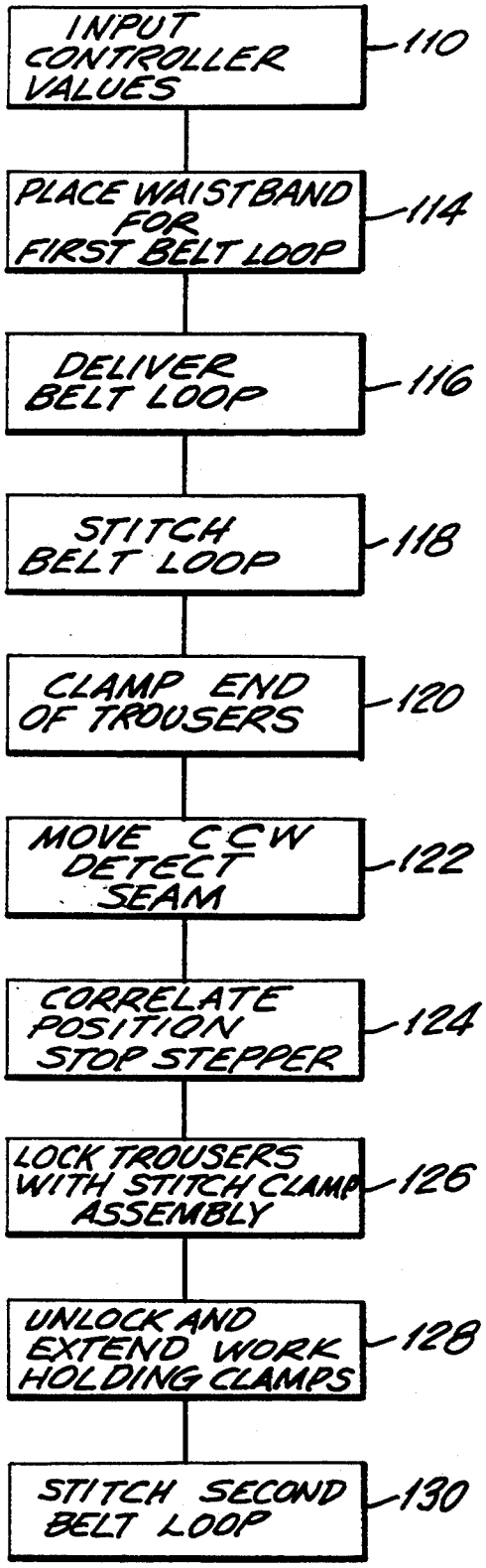
FIG. 8 is a block diagram illustrating generally the programming and sequence of operation.
Figure 9:
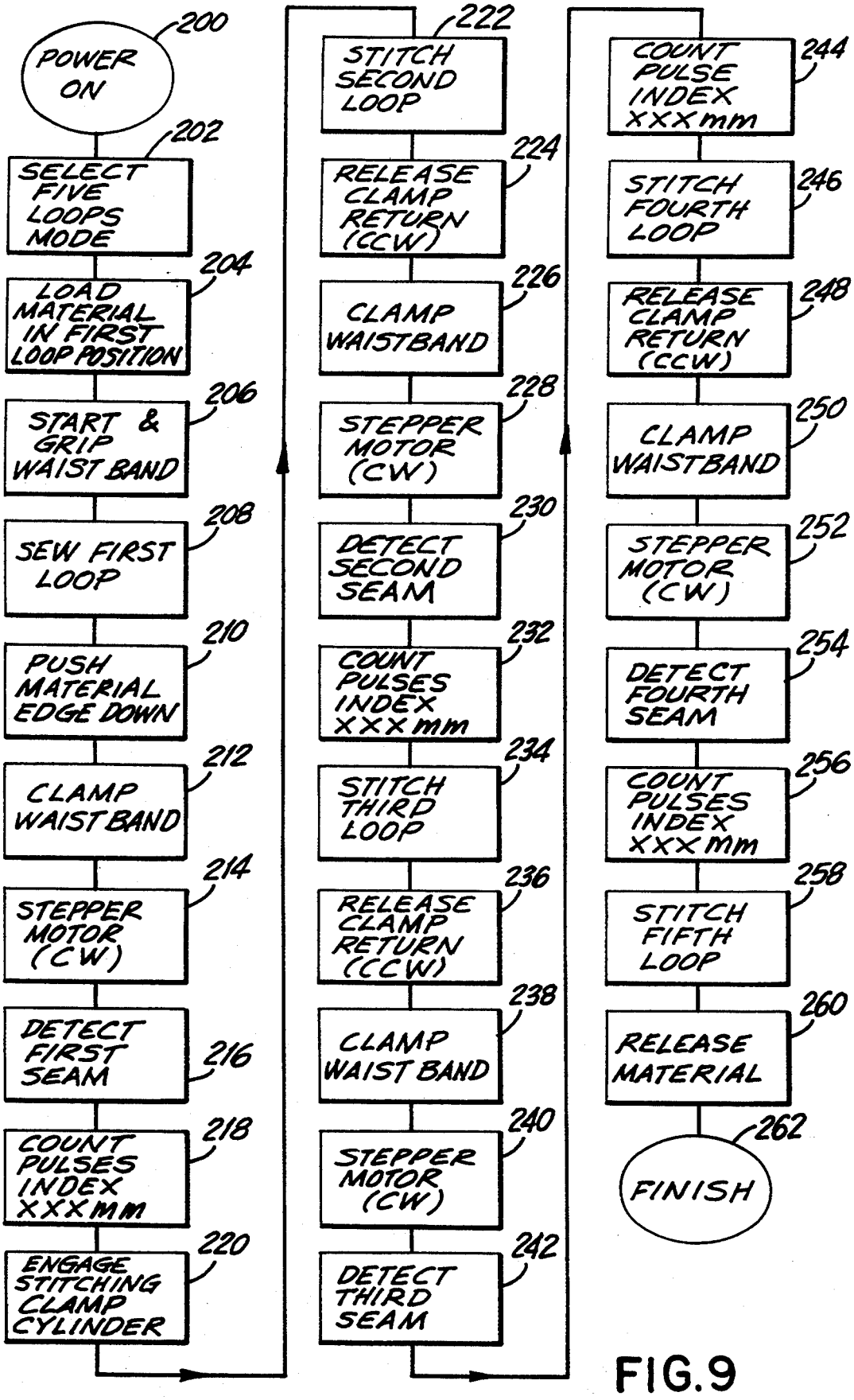
FIG. 9 is a detailed flow chart showing the steps used when stitching five belt loops.

Referring now to FIG. 8, there is illustrated a simple flow chart generally illustrating the logic control and method of operation for the present invention. FIG. 9 illustrates a more detailed flow chart where five belt loops are stitched.

Figure 3:
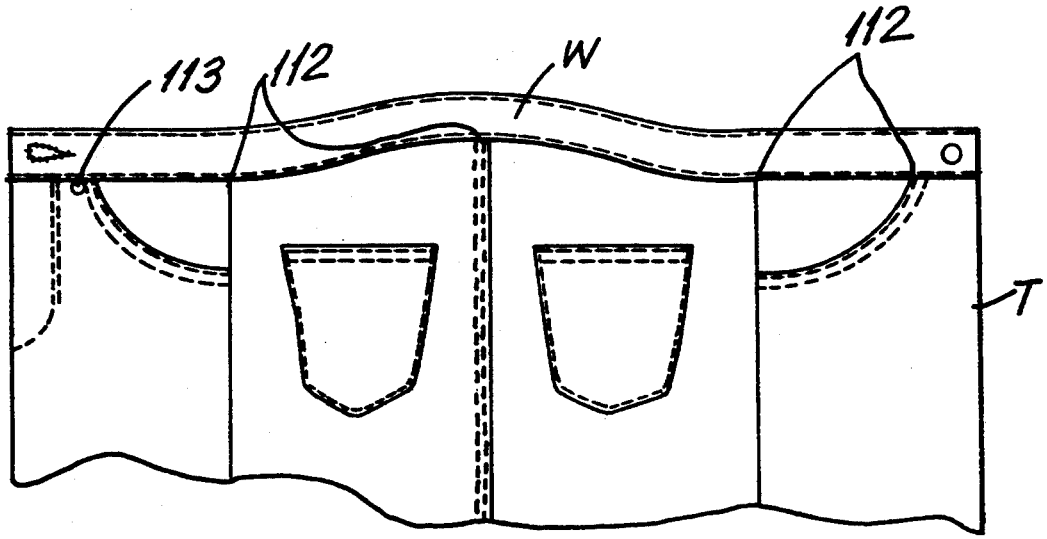
FIG. 3 is a plan view of trousers in a flat configuration showing the various seam detection points used as references for belt loop attachment positions.

In operation, the operator first inputs known values to the controller 100 such as the number of desired belt loops to be attached, and optionally the waistband length (if known) (Block 110). FIG. 3 represents a typical example of a pair of trousers showing seam detection points 112 along the waistband. As illustrated, the trousers, such as a conventional pair of jeans, has edge seams, two side seams and a rear seam. The number of seams naturally varies depending on the type of trousers, but the edge, side, and rear seams as described is typical. All machine components are in an initial "home" position. The information is preprogrammed also as to the distance past a detected seam when the belt loop should be stitched. This distance can be based on the selected number of belt loops to be stitched.

The operator then places the trousers on the sewing machine bed 13 in a belt loop attachment position where the first loop is to be stitched (Block 112). (In FIG. 1, the waistband is positioned in a second belt loop attachment position where the second belt loop is stitched onto the waistband; the operator has already stitched the first belt loop.) To stitch the first belt loop, the operator places the waistband so that a known reference point is positioned at the stitching position. Typically, the reference point is off the rivet 113 (FIG. 3) such as is found with a pair of jeans the belt loop should not cover either the seam or the rivet.

Once the waistband is properly aligned, the operator depresses a start switch (not shown) and the seam detector cylinder 44 is actuated to extend the outer guide roller assembly 40 toward the inner guide roller 32 and against the outer portion of the waistband. The vertical and horizontal pants legs rollers 96, 97, 98 are moved into position to engage the pants legs. When the operator has properly set the first belt loop attachment position at the stitching station, the belt loop delivery system 26 delivers a folded belt loop "L" to the stitching station 12 and places the belt loop into position on the waistband W. The work holding clamps 20 extend to engage the loop and hold it in place as the belt loop delivery system 26 retracts (Block 116). The belt loop then is stitched into place (Block 118). While the first belt loop is being stitched, another second belt loop is being cut from the continuous strip by means of the belt loop cut mechanism.

Once the first belt loop is stitched in place, the indexer clamp assembly 70 clamps the end of the waistband and the work-holding clamps retract (Block 120). The stepper motor 84 is rotated clockwise to pull the indexer clamp bracket 78 via the timing belt 86 downward on the bearing rail 72 which, in turn, pulls the waistband "W" counterclockwise through the stitching station (Block 122). When the first side seam (FIG. 3) moves past the seam detector, the signal generating means 66 generates a signal to the programmable control unit 100 indicative of the presence of a seam. Because the value representing the number of desired belt loops to be stitched after the first seam has been preprogrammed, the programmable control unit 100 can correlate the position where the second belt loop is to be stitched with reference to the detected side seam.

The programmable control unit maintains control over stepper motor operation and the distance the indexer clamp 74 moves by virtue of the stepper motor counts. The programmable control unit 100 signals the stepper motor 84 to stop when the second belt loop attachment position reaches the stitching station (Block 124). The cylinder output shaft 95 of the stitching clamp assembly 90 is moved against the clamp plate 92 to "lock" the trousers in position (Block 126). The second belt loop is delivered into the second belt loop attachment position. The cylinder output shaft retracts 95 while the work holding clamps 20 are extended and pressed over the belt loop (Block 128). The second belt loop then is stitched (Block 130).

Generally, the seam detection means 31 detects the position of the rear seam (FIG. 3) and stitches a belt loop thereat, while the programmable control unit 100 correlates the position of the subsequent belt loops to be attached based on the number of required belt loops. The programmable control unit maintains a record of the number of stepper motor counts since detecting the first seam to ensure that the required belt loops are attached if a belt loop is to be attached before a subsequent seam, such as the back seam or other side seam is detected.

This cycle repeats itself, while seams are detected and belt loop positions correlated by the programmable control unit 100 relative to the detected seams. After all belt loops are stitched, the different machine components return to a home position.

Referring now to FIG. 9, a more detailed flow chart illustrates the sequence and method of operation when a conventional pair of jeans has five belt loops stitched thereto in accordance with the present invention. For purposes of description, the flow chart begins with numerals in the 200 series.

The operator switches power on (block 200) by turning a main power switch (not shown) in the control housing (not shown). As noted before, the control housing has one or more toggle switches for selecting the number of loops to be stitched onto the waistband. In the present example, the operator selects the toggle switch corresponding to the five loop mode (block 202).

The operator loads the waistband onto the stitching station with a reference point just off the rivet (113) adjacent the pocket (block 204). The operator then hits the start switch and the index stitching clamp assembly engages the waistband (block 206). The first loop is stitched (block 208). The operator pushes the edge of the material downward (block 210) and the indexer clamp bracket 80 clamps the waistband (block 212).

The stepper motor rotates clockwise moving the timing belt clockwise and the indexer clamp bracket 78 downward (block 214). The downward movement of the indexer clamp bracket 78 moves the waistband through the seam detection area and the first seam is detected (block 216). When the first seam is detected, the stepper motor counts are tracked and the stepper motor indexes the waistband a predetermined set number of millimeters (block 218) in accordance with the preprogrammed instructions based on the selected five loop mode. The stitching clamp cylinder engages the waistband (block 220) and the second loop is stitched (block 222). The waistband is unclamped and the indexer clamp bracket 78 is returned to its initial upward position by rotating the stepper motor counterclockwise (block 224). The waistband is clamped again (block 226) and the stepper motor rotated clockwise (block 228). The waistband moves through the seam detection area and the second seam is detected (block 230).

The stepper motor pulses are counted and the waistband indexes a predetermined number of millimeters (block 232). The third loop is stitched (block 234). The index stitching clamp assembly is released (block 236), return to its home position, and the waistband clamped (block 238). The stepper motor is rotated clockwise to move the waistband (block 240). The third seam is detected (block 242) and the controller counts pulses to index the waistband a predetermined number of millimeters (block 244). The fourth loop is stitched (block 246).

The clamp is released and the stepper motor rotated counterclockwise to return the clamp to its home position (block 248). The waistband is clamped again (block 250) and the stepper motor rotated clockwise (block 252) to move the waistband through the seam detection area. The fourth seam is detected (block 254) and once the seam is detected, the pulses are counted to index the waistband a predetermined number of millimeters (block 256). The fifth loop is stitched (block 258). The material is released from all clamps (block 2600, finishing the stitch operation (block 262).

It should be understood that the foregoing description of the invention is intended merely to be illustrative thereof, and that other embodiments, modifications and equivalents may be apparent to those skilled in the art without departing from its spirit.

That which is claimed is:

1. A method of indexing a waistband of trousers into belt loop attachment positions at a stitching station of a sewing machine comprising moving the waistband lengthwise through the stitching station of the sewing machine by a pulsed motor movement mechanism drivingly engaged to the waistband, detecting the presence of waistband seams while the waistband moves lengthwise to provide known reference points relative to a position on the waistband where belt loops are to be stitched, and counting a predetermined number of pulses after detecting each waistband seam corresponding to a belt loop attachment position and incrementally stopping waistband movement after a predetermined number of pulses have been counted as the waistband moves into succeeding belt loop attachment positions.

2. A method according to claim 1 including the further step of placing an end of the waistband corresponding to where a first belt loop is attached onto the stitching station of the sewing machine.

3. A method according to claim 1 including the further step of determining the belt loop attachment position by incrementally moving the waistband a predetermined distance from a waistband seam that has been last detected when a subsequent waistband seam has not been detected.

4. A method according to claim 1 including moving the waistband through the stitching station by a clamp having a stepper motor drivingly connected thereto, and including the further step of controlling on-off stepper motor operation based on the position of detected seams.

5. The method according to claim 1 including the step of correlating belt loop attachment positions on the waistband with positions of detected seams while incrementally indexing the trousers lengthwise into belt loop attachment positions in accordance with a predetermined number of required belt loops.

6. A method of stitching belt loops onto a waistband of trousers comprising, placing an end of the waistband corresponding to where a first waistband loop is to be attached onto a stitching station of a sewing machine, stitching a first belt loop at a first belt loop attachment position, indexing the trousers by moving the waistband lengthwise through the stitching station by a pulsed motor movement mechanism which is drivingly connected to the trousers, while also detecting a waistband seam, counting a predetermined number of pulses after detecting each waistband seam, correlating subsequent belt loop attachment positions with a position of a detected seam in accordance with a predetermined setting of the number of required belt loops, and incrementally indexing the trousers lengthwise into belt loop attachment positions while stitching a belt loop at each belt loop attachment position.

7. The method according to claim 6 including moving the waistband through the stitching station by a clamp having a stepper motor drivingly connected thereto, and including the further step of counting stepper motor movement from a detected seam, and stopping the stepper motor after counting a predetermined number of stepper motor counts corresponding to a next belt loop attachment position on the waistband.

8. An apparatus for indexing a waistband of trousers into belt loop attachment positions at a stitching station of a sewing machine, comprising pulsed motor movement means for drivingly engaging the waistband and moving the waistband of trousers lengthwise through the stitching station, means for detecting the presence of seams, means for correlating waistband attachment positions for belt loops relative to the detected positions of seams, said correlating means including means for counting motor pulses after each detected seam, and means for incrementally stopping waistband movement after counting a predetermined number of pulses after each detected seam corresponding to belt loop attachment positions for controlling the movement of the waistband through the stitching station for stitching of belt loops onto the waistband.

9. An apparatus according to claim 8 wherein said pulse motor movement means for moving the waistband of the trousers includes an indexer clamp for engaging the trousers, and means drivingly engaging said indexer clamp for moving said indexer clamp away from said stitching station so as to pull the trousers through said stitching station.

10. An apparatus according to claim 9 including a sewing machine frame, an indexer frame attached to the sewing machine frame, and a bearing rail supported by the indexer frame, the indexer clamp being slidably mounted on the bearing rail.

11. An apparatus according to claim 10 including a stepper motor drivingly connected to said indexer clamp.

12. An apparatus according to claim 11 wherein said means for detecting the presence of a seam while the waistband is moving comprises a pivotally mounted lever that engages the waistband.

13. An apparatus according to claim 8 wherein said means for correlating the belt loop attachment position relative to the detected position of the seam comprises a programmable logic control unit.

14. An apparatus according to claim 13 wherein said programmable logic control unit is a microprocessor based computer.

15. An apparatus for stitching belt loops onto a waistband of trousers comprising, a sewing machine having a sewing machine arm defining a stitching station where belt loops are stitched onto the waistband of trousers, an indexer clamp that engages the trousers, a stepper motor drivingly connected to said indexer clamp for driving said clamp and moving the waistband of an engaged pair of trousers in one direction lengthwise through the stitching station, seam detector means for detecting a seam as the waistband is moved through the stitching station, and control means operatively connected to said seam detector means and said stepper motor for 1) receiving signals from said seam detector means indicative of the presence of a seam, 2) correlating the detected position of the seam with the attachment position of belt loops, and 3) controlling the stepper motor to stop when each of successive belt loop attachment positions are moved at the stitching station.

16. An apparatus according to claim 15 wherein said seam detector means comprises a lever that engages the waistband and pivots when engaging a seam, and signal generating means operatively connected to said control means and said lever and responsive to said pivoting action of said lever for generating a signal to said control means indicative of the presence of a seam.

17. An apparatus according to claim 15 including a frame assembly, a vertically oriented bearing rail positioned on said frame assembly and slidably supporting said indexer clamp, wherein as said indexer clamp moves downward along said bearing rail, the waistband is pulled through said stitching station.

18. An apparatus according to claim 15 including roller means positioned before said stitching station for engaging and guiding said waistband into said stitching station.

19. An apparatus according to claim 15 wherein said roller means comprises an inner guide roller that engages the inside portion of a waistband, and an outer guide roller assembly having rollers that engage the outer portion of the waistband.

20. An apparatus according to claim 19 including drive means for moving said outer guide roller assembly into and out of engagement with said inside guide roller.

21. An apparatus according to claim 14 including means for delivering belt loops to the stitching station.

22. A method of indexing a waistband of trousers into belt loop attachment positions at a stitching station of a sewing machine comprising, moving the waistband lengthwise through the stitching station of a sewing machine by a stepper motor and means drivingly engaging the stepper motor and waistband, detecting the presence of waistband seams while the waistband moves lengthwise to provide known reference points relative to the position on the waistband where belt loops are to be stitched, counting a predetermined number of stepper motor pulses after detecting each waistband seam corresponding to a belt loop attachment position, and incrementally stopping waistband movement after a predetermined number of stepper motor pulses have been counted as the waistband moves into succeeding belt loop attachment positions.

23. An apparatus for indexing a waistband of trousers into belt loop attachment positions at a stitching station of a sewing machine, comprising a stepper motor, including means drivingly engaging the stepper motor and waistband for moving the waistband of trousers lengthwise through the stitching station, means for detecting the presence of seams while the waistband is moving, means for correlating waistband attachment positions for belt loops relative to the detected position of seams, said correlating means including means for counting stepper motor pulses after each detected seam, and means for incrementally stopping waistband movement after counting a predetermined number of stepper motor pulses after each detected seam corresponding to belt loop attachment positions for controlling the movement of the waistband through the stitching station for incrementally positioning the belt loop attachment positions at the stitching station for stitching of belt loops onto the waistband.

* * * * *

UNITED STATES PATENT AND TRADEMARK OFFICE

CERTIFICATE OF CORRECTION

PATENT NO. : 5,417,174

DATED : May 23, 1995

INVENTOR(S) : Kenneth S. Allison et al.

It is certified that error appears in the above-identified patent and that said Letters Patent is hereby corrected as shown below:

On the title page, after the item [76], add the following --Assignee: JUKI AMERICA, INC. 2500 A. Meadowbrook Parkway, Duluth, Georgia 30136--.

Column 6, line 55 change "led" to --100--.

Signed and Sealed this

Eighteenth Day of June, 1996

*Attest:*

Bruce Lehman

BRUCE LEHMAN

*Attesting Officer*

*Commissioner of Patents and Trademarks*